United States Patent [19]

Podgurski

[11] 3,966,509

[45] June 29, 1976

[54] METHOD FOR REDUCING CARBON DEPOSITS DURING BOX ANNEALING

[75] Inventor: Harry H. Podgurski, Greensburg, Pa.

[73] Assignee: United States Steel Corporation, Pittsburgh, Pa.

[22] Filed: Jan. 22, 1975

[21] Appl. No.: 543,198

[52] U.S. Cl. ..... 148/16; 148/12.1; 148/14; 148/16.7

[51] Int. Cl.[2] ..... C21D 1/48

[58] Field of Search ..... 148/12.1, 14, 16, 16.7, 148/122, 112

[56] References Cited

UNITED STATES PATENTS

| | | | |
|---|---|---|---|
| 2,402,013 | 6/1946 | Billeter et al. | 148/16.7 |
| 3,058,856 | 10/1962 | Miller | 148/16 |
| 3,268,371 | 8/1966 | Daubersy | 148/16 |
| 3,303,064 | 2/1967 | Bernick et al. | 148/12.1 |

OTHER PUBLICATIONS

Iron and Steel Engineer, Nov. 1968, pp. 73–79.

*Primary Examiner*—Walter R. Satterfield
*Attorney, Agent, or Firm*—A. J. Greif

[57] ABSTRACT

In the box annealing of ferrous metal sheets, the occurrence of carbon deposits and staining is materially reduced by initially heating the sheet in a protective atmosphere which is essentially a mixture of $N_2$ and $H_2$ and then modifying the atmosphere so that during the soak period it contains at least about 3% $CO_2$, 3% CO, 4% $H_2$ and 0.5% $H_2O$, balance $N_2$. Atmosphere modification is effected only after the sheet portions, which are exposed to the protective atmosphere, reach a predetermined, minimum replacement temperature within the range 1000° – 1400°F.

5 Claims, 1 Drawing Figure

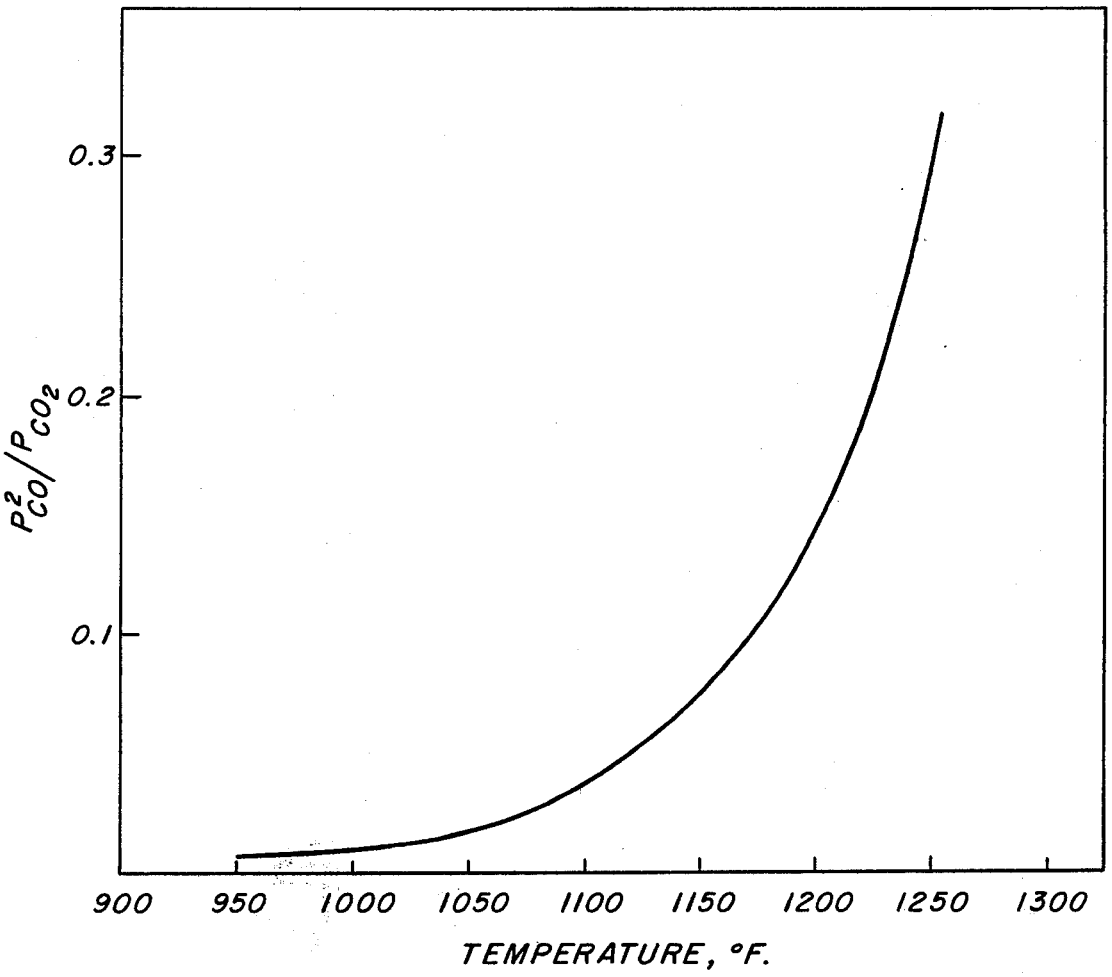
0.3
0.2
0.1
$P^2_{CO}/P_{CO_2}$
900
950
1000
1050
1100
1150
1200
1250
1300
TEMPERATURE, °F.

METHOD FOR REDUCING CARBON DEPOSITS DURING BOX ANNEALING

This invention relates to the box annealing of metal sheet material and is more particularly related to a method for eliminating carbon deposits during such annealing.

Ferrous sheet material is generally annealed by a practice known as box annealing. The material, in the form of sheared sheets or more commonly in the form of coils, is placed on base stools. Thermocouples are then positioned at desired locations in the sheet and the furnace is lowered onto the base over an inner cover that provides an enclosure into which a controlled protective atmosphere is admitted prior to or during the annealing cycle. A variety of protective atmospheres may be employed. One commonly employed protective atmosphere utilizes gases prepared by the partial combustion of hydrocarbon gases, eg. natural gas, propane, butane. Another well known protective atmosphere is prepared by the mixing of $H_2$ and $N_2$. Whatever the gases employed, it is preferable in addition to preventing an undesirable degree of oxidation and decarburization of the metal, that the atmosphere employed not be the source of carbon deposits; and preferably be capable of removing any carbon deposits which may result from other sources, i.e. rolling lubricants remaining on the sheet material. In the annealing of ferrous sheet material the choice of atmosphere is often determined by the end use of the annealed sheet. Thus, when coatability of the ferrous sheet is of prime importance, a protective atmosphere consisting essentially of $N_2$ and $H_2$ with small traces of moisture (HNX gas) is commonly employed. On the other hand, when it is essential that a smooth surface be retained, even after severe forming operations, an atmosphere consisting essentially of $N_2$, $H_2$, $CO_2$, CO and $H_2O$ (DX gas) is often employed. However, neither of these commonly employed atmospheres, used alone, is generally capable of eliminating the above causes of carbon deposits.

It is therefore a principal object of this invention to provide a method for modifying the protective atmosphere during annealing to enhance the cleanliness of metal surfaces.

It is a further object of this invention to provide a method for the annealing of ferrous sheet material whereby carbon deposits may essentially be eliminated.

These and other objects and advantages of the inventive method will be better appreciated from a reading of the following description when taken in conjunction with the appended claims and the drawing wherein:

The FIGURE is a graph for determining the approximate predetermined replacement temperature as a function of the CO and $CO_2$ contents, for an atmosphere containing about 10% $H_2$ and 1% $H_2O$.

It has now been discovered that upon attaining a prescribed elevated temperature, enhanced removal of carbon deposits from sheet can be achieved in what may be termed a DX type atmosphere, i.e. one containing at least about 3% $CO_2$, 3% CO, 4% $H_2$ and 0.5% $H_2O$. Heating of the sheet is initially accomplished in a first atmosphere which is essentially devoid of CO and $CO_2$, eg. an HNX type atmosphere, an atmosphere containing only $N_2$, or in certain instances the use of air. When those portions of the sheet which come in contact with the protective atmosphere attain a predetermined, minimum replacement temperature (MRT), the first atmosphere is purged and replaced by the DX type atmosphere. If the switch in atmospheres is accomplished too early, the DX type atmosphere will, itself, act as a source for carbon deposition. Therefore, it is essential that such atmosphere replacement only be accomplished after the exposed sheet portions (eg. the outer wraps and sheet edges in coiled product) have actually attained or exceeded the predetermined MRT. While atmosphere replacement may be accomplished at a period of time long after the attainment of the MRT, such a practice is less desirable in that it is wasteful of that time period which could have been employed for removal of carbon deposits. Therefore, the costlier DX type atmospheres will be employed to best advantage, if the annealing atmosphere is switched soon after attainment of the predetermined replacement temperature.

The predetermined, minimum replacement temperature is a function of the concentration of the carbon gasification atmosphere and will generally be within the range of 1000° to 1400°F. However, because this atmosphere can vary between wide concentration limits and contain a variety of constituents, it is not possible to prescribe a formula for calculating this temperature with a sufficient degree of accuracy. The figure provides an example of how this replacement temperature varies as a function of CO and $CO_2$ contents for an atmosphere containing about 10% $H_2$ and 1% $H_2O$, and is therefore useful for establishing the many commonly employed DX atmospheres. Employing gases with a higher ratio of $H_2$ to $H_2O$ will move the curve to the right, thereby requiring the attainment of higher sheet temperatures (in the exposed regions) prior to effecting a switch in atmospheres. Similarly, if the ratio of $H_2O$ to $H_2$ is increased, the curve will move to the left; thereby decreasing the MRT.

The figure may, of course, be employed as guide. However, since the most desirable MRT will vary not only with the concentration of the DX type gases, but also with (a) the concentration of gases in the first protective atmosphere, (b) the rate of purging said first atmosphere, (c) the heat-up rate of the coil or stack and (d) the portion of sheet (tight or loosely wound coils, etc.) exposed to the protective atmosphere; it is advisable that the predetermined MRT be determined empirically, eg. by trial and error tests. Of course, it is not an absolute necessity that replacement temperature determinations be made in full scale tests. Approximate MRT determinations can easily be made by utilizing a sample sheet placed in a small oven or furnace, eg. a muffle furnace, wherein the gases and purging rates analagous to those employed for actual annealing, are also employed in the determination procedure. A laboratory test of this sort, wherein atmosphere switching is effected at 50°F intervals (within the range 1000° – 1400°F) will be adequate for approximating the minimum temperature at which such switching can safely be accomplished, i.e., without the DX type atmosphere, itself, being the source of carbon deposits.

The MRT is also of importance near the end of the annealing cycle when the temperature of the exposed portions of the sheet begins to decrease. Thus, when the temperature of such exposed portions drops below the MRT, undesirable carbon deposition could again occur. In those instances where such deposition does occur, it will be necessary to purge the DX type atmosphere with one essentially free of CO and $CO_2$. For example, such purging could be achieved by reverting to the first atmosphere employed during the initial heating phase. Fortunately, in box-annealing, such a switch back procedure will not ordinarily be required, if the annealing furnace is reasonably quickly removed from the annealing base at the end of the soak. When the furnace is so removed, the steel cover enclosing the annealed coil is rapidly chilled well below the coil temperature. Because of the large temperature differential generated between the cover and the coil, the resulting carbon deposition will be directed to the colder cover. However, in those unusual cases where the annealing furnace is not early removed at the end of soak, a switch back to an atmosphere essentially devoid of CO and $CO_2$ would then be warranted.

The gas switching practice, as outlined above, has now been employed in actual mill practice and found to be extremely effective in reducing, and in most cases eliminating, carbon deposits on annealed coils. However, in come cases, i.e., where unusually large quantities of lubricants remain on the cold rolled sheet, the effectiveness of the gas switching practice will be further enhanced if the temperature rise of the coils is sufficiently slow during the initial heating phase when the coils are heated to soak temperature. If the temperature rise of the coils is too rapid during heat-up, the rolling lubricants remaining on the sheet will thermally decompose (at the pressures employed in conventional box-annealing) to solid carbonaceous products. Furthermore, decomposition products formed at higher temperatures tend to be less reactive to gasification. When coils are heated up at a relatively slow rate, the temperature gradient between the interior coil wraps and the more exposed regions (outer wraps and sheet edges) is materially reduced. It is therefore desirable that heat-up procedures be employed wherein the temperature of the interior coil wraps is sufficient to favor hydrocracking of the lubricant, (eg. 550°F) and therefore the production of a volatile reaction product; while the temperature of more exposed regions is nevertheless below that (eg. 1000°F), at which rapid carbonization would occur. This desired objective is most easily accomplished by a procedure in which the outermost and therefore hottest portions of the coils may be heated rapidly to a temperature shelf, eg. 950° –1050°F, and held at such temperature for a time at least sufficient for the innerwraps to reach a temperature of 500° to 600°F. For wide and/or large diameter coils, in particular, the use of such a shelf practice may require an additional heat-up time of, for example, 8 hours over that of conventional heat-up rates. Such additional time is obviously costly. Therefore, it should be understood that such a shelf practice is recommended only in those obstinant cases where it is seen that the gas-switching procedure of this invention is, alone, not sufficient to achieve the desired degree of sheet cleanliness.

I claim:

1. In the box annealing of ferrous metal sheet, wherein said sheet is heated in a controlled protective atmosphere to a soak temperature within the range 1000° –1700°F and held at such soak temperature for a time sufficient to effect desired softening thereof, the improvement for significantly reducing the occurrence of carbon deposits which comprises, a. during the initial heating period when the temperature of said sheet is being raised; employing a first gaseous atmosphere which is essentially devoid of CO and $CO_2$, consists essentially of at least 5% $H_2$, at least 0.2% $H_2O$, balance $N_2$, and b. subsequent to the time the temperature of exposed portions of said sheet reaches a minimum replacement temperature, said minimum replacement temperature being within the range 1000° – 1400°F, adjusting the controlled protective atmosphere to a second atmosphere consisting essentially of 3 – 30% $CO_2$, 3 – 30% CO, 4 – 20% $H_2$, 0.5 – 5% $H_2O$, balance $N_2$, and maintaining said second atmosphere during the soak.

2. The method of claim 1, wherein said second atmosphere consists essentially of 4 – 10% $CO_2$, 7 – 15% CO, 6 – 14% $H_2$, 0.5 – 2% $H_2O$, balance $N_2$.

3. The method of claim 2, wherein $P^2CO/P_{CO_2}$ is between about 0.04 and 0.3 and said predetermined shift temperature is greater than the temperature, as shown by the curve in the figure, corresponding to said ratio.

4. The method of claim 1, wherein said first atmosphere preferably consists essentially of 7 –15% $H_2$, 0.3 – 2% $H_2O$, balance $N_2$.

5. The method of claim 4, wherein at a time subsequent to said desired soak when the temperature of said sheet begins to substantially decrease, readjusting said gaseous atmosphere so that it is essentially devoid of CO and $CO_2$ prior to the time the temperature of the exposed portions of said sheet reaches said minimum replacement temperature.

* * * * *